US005711627A

United States Patent [19]

Chapman

[11] Patent Number: 5,711,627

[45] Date of Patent: Jan. 27, 1998

[54] FLEXIBLE SPINE BINDER WITH WINDOW POCKET AND SPINE STIFFENER INSERT

[76] Inventor: David R. Chapman, 145 Wychwood Place, London, Ontario, Canada, N6G 1S7

[21] Appl. No.: 646,389

[22] Filed: May 8, 1996

[51] Int. Cl.[6] ..... B42F 13/00

[52] U.S. Cl. ..... 402/3; 402/73; 402/502; 281/29; 281/31

[58] Field of Search ..... 402/3, 4, 73, 74, 402/80 R, 76, 502, 75, 77; 281/15.1, 21.1, 29, 31, 36, 37; 412/3, 17

[56] References Cited

U.S. PATENT DOCUMENTS

| | | | |
|---|---|---|---|
| 193,587 | 7/1877 | Wright | 402/3 |
| 624,195 | 5/1899 | Douglas | 281/17 |
| 1,677,277 | 7/1928 | Federbush et al. | 402/3 |
| 2,557,190 | 6/1951 | Jolly | 402/3 |
| 2,852,275 | 9/1958 | Brook | 402/3 X |
| 3,175,847 | 3/1965 | McKowen | 281/36 |
| 4,629,349 | 12/1986 | Pitts | 281/31 X |
| 4,681,472 | 7/1987 | Ruble . | |
| 4,838,724 | 6/1989 | Spence, Jr. . | |
| 4,856,817 | 8/1989 | Moor | 281/36 |
| 4,892,333 | 1/1990 | Krulich . | |
| 4,998,840 | 3/1991 | Ruble . | |
| 5,020,828 | 6/1991 | Moor | 281/36 X |
| 5,030,027 | 7/1991 | Bachrach et al. | 281/29 |
| 5,087,078 | 2/1992 | Phillips . | |
| 5,213,368 | 5/1993 | Wyant . | |
| 5,222,825 | 6/1993 | Wyant | 402/73 X |
| 5,330,279 | 7/1994 | Ruble . | |
| 5,607,246 | 3/1997 | Podosek | 402/73 |

FOREIGN PATENT DOCUMENTS

| | | | |
|---|---|---|---|
| 2656021 | 6/1978 | Germany | 402/3 |
| 203074 | 4/1980 | United Kingdom | 281/36 |

OTHER PUBLICATIONS

The 1989 Jacobs Gardner Catalog, p. 783, 1989.

*Primary Examiner*—Frances Han
*Attorney, Agent, or Firm*—Stanley E. Johnson

[57] ABSTRACT

A flexible spine binder with an open pocket extending the length of the spine and a stiff elongate member insertable into such pocket transforming the flexible spine into a stiff spine and also providing means for labelling the binder. The binder is made of film vinyl, polypropylene or the like.

18 Claims, 3 Drawing Sheets

FLEXIBLE SPINE BINDER WITH WINDOW POCKET AND SPINE STIFFENER INSERT

FIELD OF INVENTION

This invention relates to loose leaf binders and particularly to a binder having a flexible spine, a window pocket on the spine and a removably insertable spine stiffener which also serves as a content label or label bearing member.

BACKGROUND OF THE INVENTION

Window pocket binders, also referred to as "Show Window" binders are well known and have evolved generally due to the high cost of making binders with printing applied thereto. A window pocket binder allows the user to adapt the binder to his particular needs and purpose by inserting his own printed sheet into the window pocket. A label is inserted into the spine pocket to identify the binder contents.

The paper inserts can be changed which makes the window pocket binder more versatile than the printed binder. This change of purpose however normally requires changing the pocket label.

The problem that arises is the difficulty of inserting a paper sheet or label into the pocket in the spine.

A further and more severe problem arises in attempting to replace the label in the spine pocket as may be dictated from a change in purpose for the binder.

One solution directed to the problems of inserting a label in the spine is proposed in U.S. Pat. No. 4,681,472 which issued Jul. 21, 1987 to P. E. Ruble. The patentee discloses using a separate pull string or ribbon that extends through the spine pocket and is attachable to a label sheet for pulling the same into the pocket. This obviously requires an opening not only in the top of the pocket for insertion of the label but also in the bottom of the pocket for the pull string or pull ribbon as the case may be. It is a one shot solution as the ribbon is disposed of after its first use.

Another solution is disclosed in U.S. Pat. No. 4,892,333 which issued Jan. 9, 1990 to R. F. Krubick. The patentee discloses a window pocket insertion device. The device is a separate tool and not part of the binder. It is composed of two elongate flat prongs made of stiff but flexible material and joined together at one end to form a handle.

In the foregoing related art the binders have a stiff spine. Binders having a flexible spine are known and by way of example reference may be had to U.S. Pat. No. 5,213,368 which issued May 25, 1993 to J. R. Wyant and is assigned to The Mead Corporation. In a variant shown in FIGS. 8 and 9 a portion of the flexible spine has a stiffener strip described as being "sandwiched by the inner and outer plastic layers".

A conventional window pocket binder has stiff covers attached to a stiff spine. The spine consists of a piece of normal binder chip board sandwiched between two layers of pigmented vinyl. The front and back covers are each similarly constructed and they are hingedly attached to the spine by the absence of an insert where they join.

SUMMARY OF THE INVENTION

An object of this invention is to provide a binder in which the spine is flexible and rendered stiff by insertion of a separate stiff elongate member into an open pocket in the spine and wherein such insert serves as a label or label support.

A further object of the present invention is to provide a binder of the foregoing features and including means to releasably lock the insert in the spine.

A further object of the present invention is to provide a flexible spine "show window" pocket binding made of polyolefin based film material, preferably polypropylene.

LIST OF DRAWINGS

The invention is illustrated by way of example in the accompanying drawings wherein.

DETAILED DESCRIPTION OF PREFERRED EMBODIMENT

Figure 2:
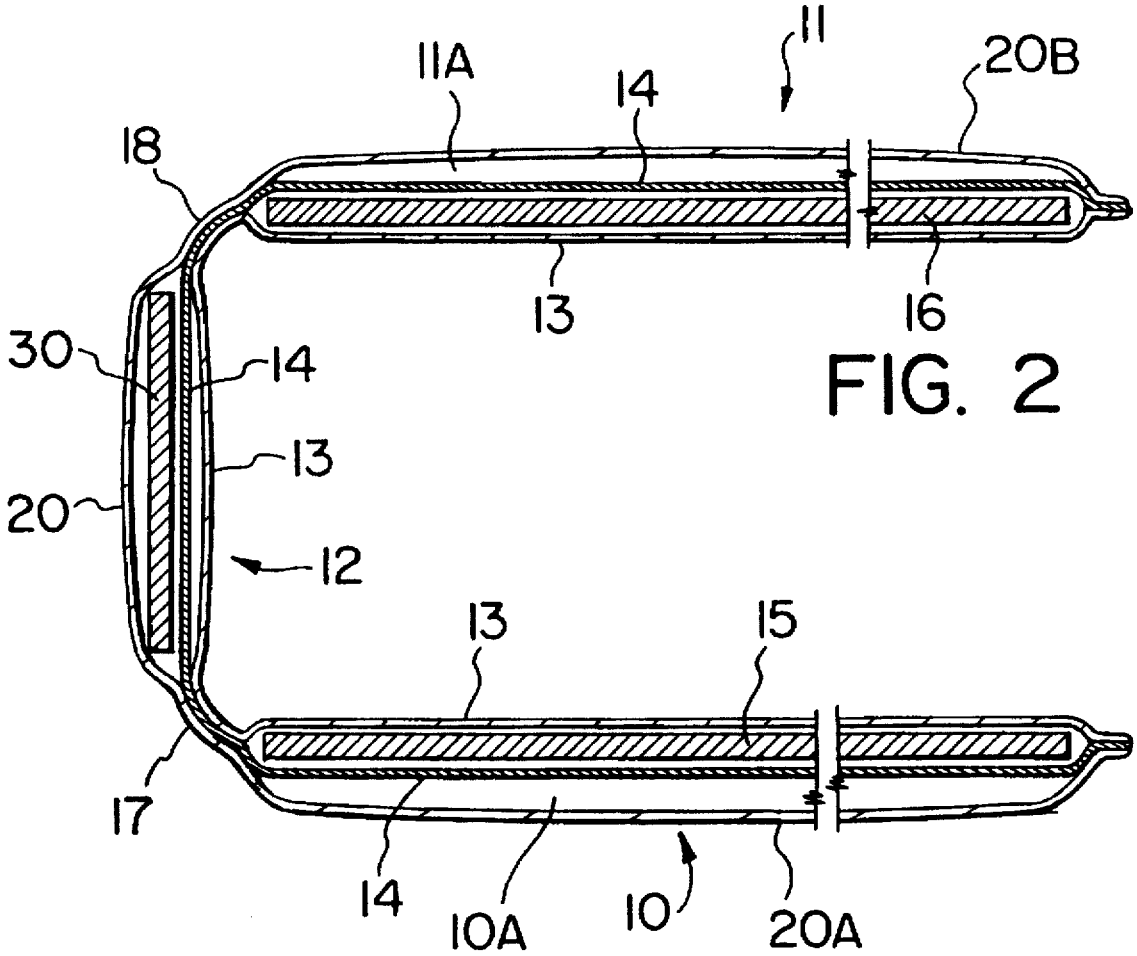
FIG. 2 is a cross-sectional view taken essentially along line 2—2 of FIG. 1.
Figure 4:
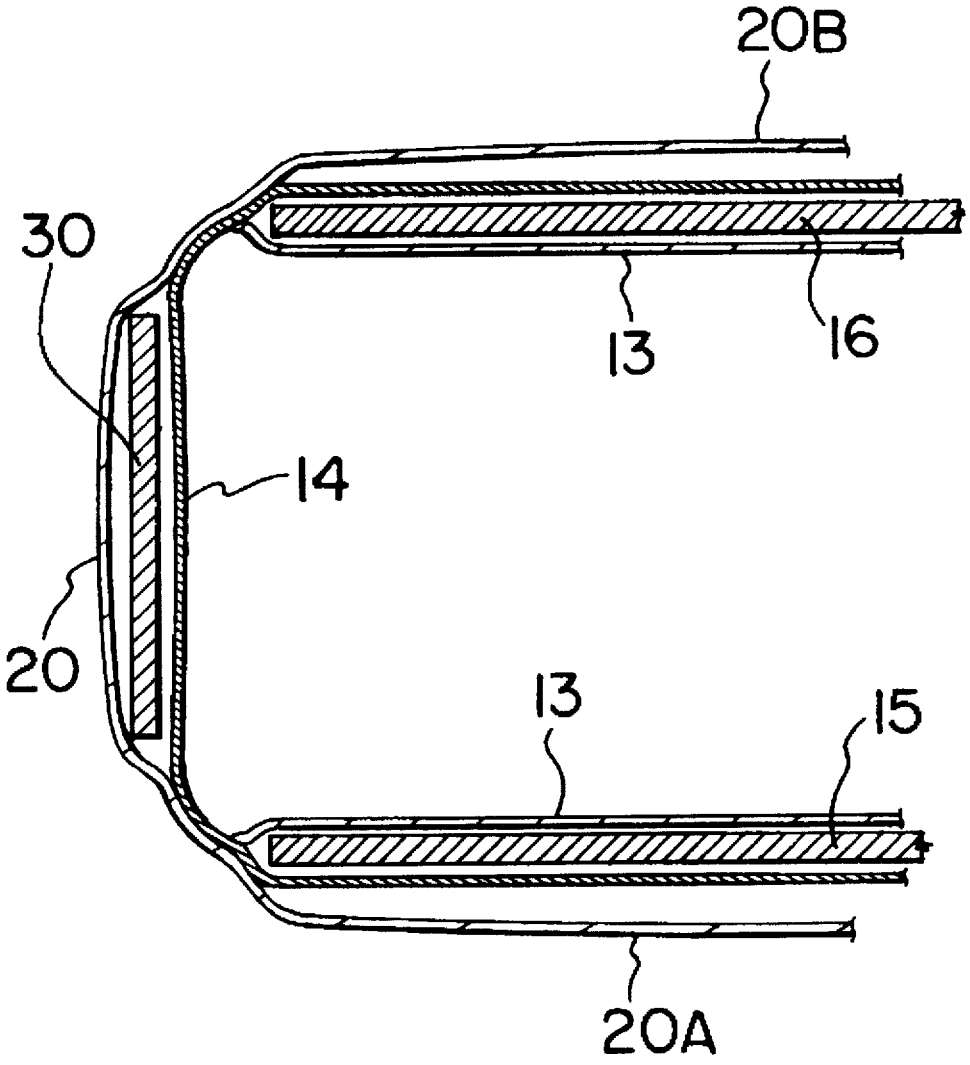
FIG. 4 is a partial sectional view similar to the left hand portion of FIG. 1 and illustrating a modified construction for the flexible spine.

Referring to the drawings there is illustrated a loose leaf binder having respective front and rear covers 10 and 11 and a flexible spine 12. As seen from FIG. 2 the covers 10 and 11 each have (pigmented vinyl) inner and outer sheet layers designated 13 and 14 heat seal welded along the periphery to provide a pocket for respective inserts 15 and 16. These inserts are normally stiff pasted chip board but instead of being stiff inserts they could be somewhat flexible. The inner and outer sheets 13 and 14 are heat sealed together providing respective hinges 17 and 18 that connect the front and rear covers 10 and 11 to the flexible spine 12. The flexible spine may be a single layer 13, or a single layer 14, or both layers 13 and 14. In FIG. 4 the flexible spine is shown as a single layer 14 and in FIG. 2 the spine is composed of two layers.

A transparent vinyl sheet 20 is attached to the spine by heat sealing along the hinges 17 and 18 and provides a pocket which is open at the top for insertion thereinto a label or label bearing insert 30. The insert 30 is a stiff member that is suitably labelled by the user and then inserted into the pocket and in that it is a stiff member it transforms the flexible spine into a stiff spine. Labelling information may be made directly on the insert 30 or a separate label may be adhesively or otherwise attached thereto.

Figure 3:
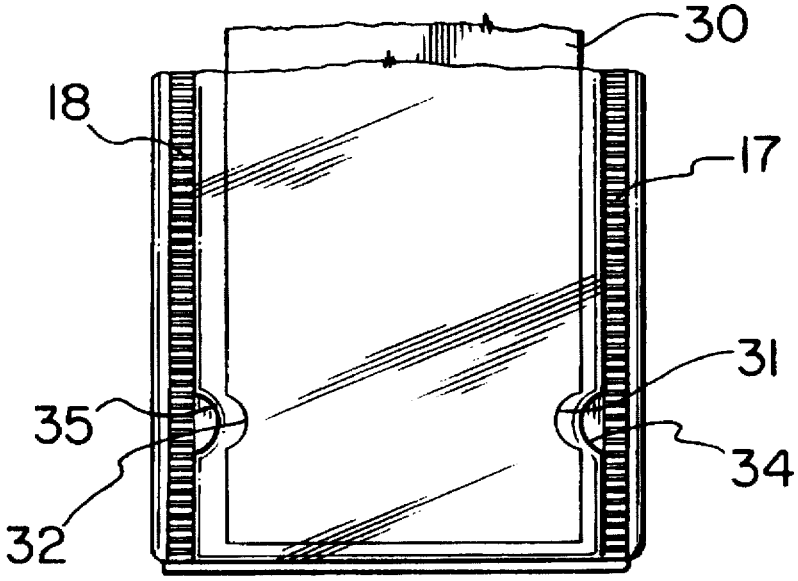
FIG. 3 is a partial elevational view of the lower end portion of the spine of the binder of FIG. 1.

The label carrying spine stiffener 30 is preferably releasably locked in the pocket and one such means for doing so is illustrated in FIG. 3. Referring to FIG. 3 the spine stiffener label bearing member 30 has notches 31 and 32 in respective opposite edges thereof and these mate with a necked down or a reduced width in the pocket provided by weld enlargements 34 and 35. These weld enlargements are the heat seal welding of the transparent layer 20 to the respective hinge seam lines 17 and 18. For purposes of clarity of illustration the notches 31 and 32 are shown spaced from the respective enlargements 34 and 35 but in actual practice a mating interference fit relation would occur. The elasticity of the vinyl allows forcing the insert between the enlargements and as the vinyl relaxes the enlargements project into the notches (or form notches in the insert) providing a "locked in" spine. The notches 31 and 32 may be preformed in the spine insert 30 or they may form during use. While two enlargements (34, 35) are preferred only one is required to narrow the width of the pocket.

Figure 1:
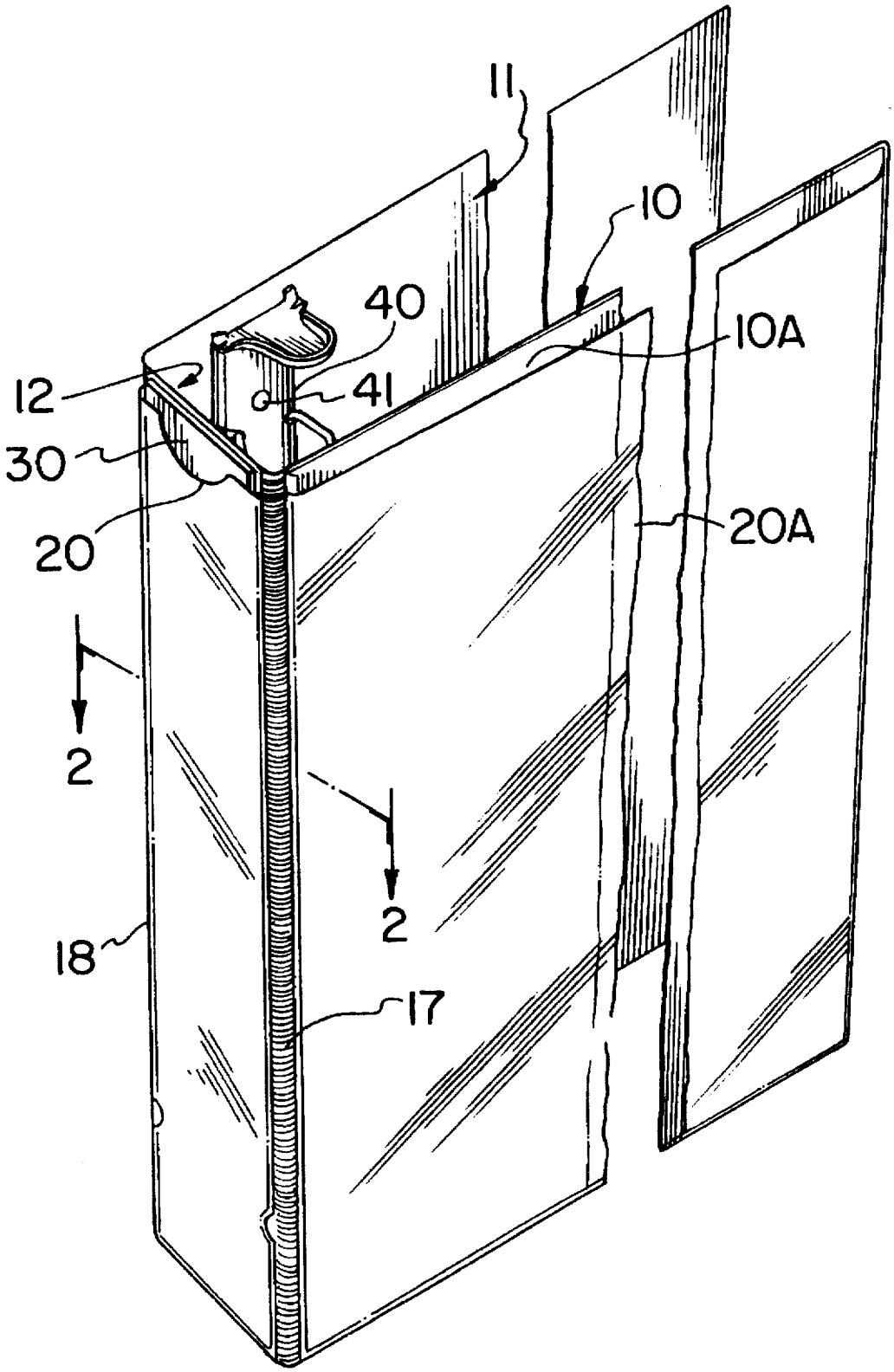
FIG. 1 is a partially oblique broken view of a "Show Window" type binder of the present invention.

The binder as illustrated in FIG. 1 has a conventional multiple ring mechanism 40 and in the illustrated embodiment it is attached to the rear cover 11 by a plurality of rivets 41 (only one of which is shown). The mechanism 40 or equivalent provides means for retaining sheet material in the binder.

The pocket insert 30 preferably projects slightly out of the pocket when fully inserted thereinto and/or a notch is provided as for example notch 50 shown in FIG. 1 so that a finger grip portion of the insert is exposed for use in removing the insert from the pocket. The opposite, i.e. the bottom end of the pocket is preferably closed by heat seal welding of the vinyl sheet 20 to the spine.

The foregoing binder is constructed normally using high frequency welding to join together the vinyl sheet material providing the hereinbefore referred heat seal welding. The binder however, instead of vinyl may be made of other polyolefin based materials for example polypropylene. This may be used in place of both the pigmented and clear vinyl film described in the foregoing. When making the binder from polyolefin based material bonding of the film may be done by either ultra sonic welding (sound waves) or impulse welding (an instantaneous thermal transfer weld).

I claim:

1. A binder comprising front and rear covers interconnected by a spine and including means for releasably retaining sheet material in said binder, said spine being flexible and having an open pocket extending substantially along the entire length thereof, a stiff insert removably insertable into said open pocket transforming said flexible spine into a stiff spine and also providing means for labelling said binder.

2. A binder as defined in claim 1 wherein said pocket is provided by a sheet of material attached to said spine.

3. A binder as defined in claim 2 wherein said sheet of material is transparent and heat seal welded to said spine.

4. A binder as defined in claim 1 including means removably locking said insert in said pocket.

5. A binder as defined in claim 4 wherein said locking means comprises a necked down narrow portion in said pocket and a notch in said stiff insert to receive therein said necked down narrower pocket portion.

6. A binder as defined in claim 5 including a weld enlargement in said heat seal welding providing said pocket necked down narrower portion.

7. A binder as defined in claim 6 including a pair of said weld enlargements, one of said weld enlargements being located on one longitudinal marginal edge of the pocket and the other enlargement being on a longitudinal marginal edge of said pocket opposite said one longitudinal marginal edge.

8. A binder as defined in claim 7 wherein said enlargements are opposite one another and project in a direction toward one another.

9. A binder as defined in claim 8 wherein said enlargements are spaced a selected distance from a bottom end of said pocket, said pocket bottom end being closed.

10. A binder comprising front and rear covers, a flexible spine and means for retaining sheet material in said binder, said front cover being attached to one outer longitudinal edge of the spine and the back cover to a longitudinal edge of said spine opposite said one edge, a sheet of material attached to said spine and providing, together with said spine a pocket, said pocket being open at the top and extending substantially the full length and width of the spine and an elongate stiff member removably insertable into said pocket transforming said flexible spine into a stiff spine and also providing means for use in having labelling thereon to identify the contents of the binder, said sheet of material, attached to the spine, being transparent at least in part and wherein said labelling is exposed through such transparent part when the insert is located in said pocket.

11. A binder as defined in claim 10 wherein each of said front and rear covers comprise an inner vinyl sheet, an outer vinyl sheet and means between said sheets providing the desired stiffness for said covers and wherein at least one of said inner and outer vinyl sheet of one cover extends to the other of said front and rear covers to provide said flexible spine.

12. A binder as defined in claim 10 wherein each of said front and rear covers comprise an inner polyolefin sheet, an outer polyolefin sheet and means between said sheets providing the desired stiffness for said covers and wherein at least one of said inner and outer polyolefin sheet of one cover extends to the other of said front and rear covers to provide said flexible spine.

13. A binder as defined in claim 10 wherein each of said front and rear covers comprise an inner polypropylene, an outer polypropylene and means between said sheets providing the desired stiffness for said covers and wherein at least one of said inner and outer polypropylene of one cover extends to the other of said front and rear covers to provide said flexible spine.

14. A binder as defined in claim 10 including means removably locking said spine insert in said pocket, said locking means comprising a selected area of reduced width in said pocket, said reduced width being less than the width of said spine insert.

15. A loose leaf binder comprising front and rear stiff covers each joined at one edge thereof to a flexible spine; a flexible sheet of transparent material attached to marginal edges of the spine providing a pocket overlying substantially the entire length and width of the spine, a stiff elongate slender member removably insertable into said pocket and corresponding essentially to the full length and width thereof, said stiff member providing a stiff spine for the binder when inserted into said pocket and a base for labelling, means releasably retaining said stiff member in said pocket, said means comprising a selected area of reduced width in said pocket in which such reduced width is narrower than the width of said stiff member and means for retaining sheet material in said binder.

16. A loose leaf binder as defined in claim 15 including a further pocket on at least one of said covers.

17. A loose leaf binder as defined in claim 15 including transparent sheet vinyl material on each of said front and rear covers, said transparent sheet material being attached to the cover associated therewith providing pockets which are open along one edge thereof.

18. A loose leaf binder as defined in claim 15 including a transparent sheet of material on at least one of said covers providing a pocket and wherein said sheet of material and said covers are film polypropylene.

* * * * *